US005675883A

United States Patent [19]

Gaag et al.

[11] Patent Number: 5,675,883

[45] Date of Patent: Oct. 14, 1997

[54] METHOD OF MANUFACTURING A COPPER-NICKEL-SILICON ALLOY CASING

[75] Inventors: Norbert Gaag; Peter Ruchel, both of Lauf, Germany

[73] Assignee: Diehl GmbH & Co., Nuremberg, Germany

[21] Appl. No.: 429,525

[22] Filed: Apr. 26, 1995

[30] Foreign Application Priority Data

Apr. 29, 1994 [DE] Germany ..... 44 15 067.9

[51] Int. Cl.[6] ..... H05K 5/00; B21B 1/00

[52] U.S. Cl. ..... 29/527.7; 148/432; 148/435; 174/17.05; 174/52.5; 420/469; 420/485

[58] Field of Search ..... 29/527.7; 420/469, 420/472, 473, 485; 174/52.5, 17.05

[56] References Cited

U.S. PATENT DOCUMENTS

| | | | |
|---|---|---|---|
| 4,337,089 | 6/1982 | Arita et al. . | |
| 4,345,108 | 8/1982 | Dathe et al. | 174/52.5 |
| 4,375,008 | 2/1983 | Dathe | 174/52.5 X |
| 4,466,939 | 8/1984 | Kim et al. . | |
| 4,486,622 | 12/1984 | Dathe et al. | 174/52.5 |
| 4,620,885 | 11/1986 | Igata et al. | 420/472 X |
| 4,656,003 | 4/1987 | Miyafuji et al. | 148/435 X |
| 5,441,696 | 8/1995 | Kubosono et al. . | |

FOREIGN PATENT DOCUMENTS

| | | | |
|---|---|---|---|
| 1278110 | 9/1968 | Germany . | |
| 3417273A1 | 11/1985 | Germany . | |
| 59-59866 | 4/1984 | Japan | 148/435 |

*Primary Examiner*—Carl Arbes

*Attorney, Agent, or Firm*—Scully, Scott, Murphy and Presser

[57] ABSTRACT

The invention relates to a method of manufacturing a copper-nickel-silicon alloy with a composition Cu (balance), Ni 1.5–5.5%, Si 0.2–1.05, Fe 0–0.5% and Mg 0–0.1% (all in percent by weight), and use of the alloy for pressure-englazable casings. The method permits an alloy with a very high elastic limit with very good conductivity and good cold reformability and differs from the conventional method of manufacturing such alloys by heating to about 950° C. and fairly rapid cooling after a preceding cold rolling operation. An improvement in the properties can be achieved by ageing of the alloy at 300° C. to 600° C. for several hours.

11 Claims, 6 Drawing Sheets

METHOD OF MANUFACTURING A COPPER-NICKEL-SILICON ALLOY CASING

BACKGROUND OF THE INVENTION

1. Field of the Invention

The invention relates to a method of manufacturing a copper-nickel-silicon alloy of a composition Cu (balance), Ni 1.5–5.5%, Si 0.2–1.0%, Fe 0–0.5% and Mg 0–0.1% (all in percent by weight). Alloys of that kind have long been known and are used with or without further additional substances, in particular as a conductor material in the electrical art and in particular as a conductor material for electronic components.

2. Discussion of the Prior Art

German published specification (DE-AS) No. 12 78 110 describes for example a copper-nickel-silicon alloy comprising 2% Ni and 0.5% Si, with the balance copper, in regard to which however, while admittedly being of good strength, deformability is judged to be very poor. That publication also described copper-nickel-silicon alloys (CuNiSi) in which the addition of small amounts of chromium is essential. Those alloys enjoy good cold deformability whereas the question of conductivity plays no part in regard to the use described therein.

DE 34 17 273 Al also discloses a copper-nickel-silicon alloy with an addition of phosphorus, as an electrical conductor material. Good electrical conductivity is in the foreground with that alloy, with an adequate level of strength.

SUMMARY OF THE INVENTION

In contrast the invention is directed to a different technical area. It is to be used where the important considerations are good electrical conductivity, good cold deformability during the method and a very high elastic limit or yield point, with the particularity that the elastic limit of the alloy increase upon being cooled down from high temperatures. A preferred area of use of the invention is therefore in relation to pressure-englazable metallic casings, in particular those in which an important consideration is hermetic sealing of the pressure-englazing means in the casing.

Therefore the object of the present invention is to provide a method for manufacturing a copper alloy which increases its elastic limit upon being cooled down and which, besides a very high elastic limit, enjoys good conductivity (electrical and thermal) and cold deformability.

In accordance with the invention such as alloy (CuNiSi) of the composition set forth in the opening part of this specification is produced with the following method steps:

a) casting the alloy b) solution treatment at 700°–900° C. for a period of 14–1 hour c) cold rolling with a reduction of at least 80% d) heating to 950° C. and e) cooling at at most 100° C./min to at least 350° C.

An essential consideration for achieving a high elastic limit which, as will be further described hereinafter, differs to a quite surprising degree from that of conventional CuNiSi-alloys is heating and re-cooling of the alloy in accordance with features d) and e). The value of 950° C. is to be maintained approximately, that is to say with a tolerance limit of 20° to 30° C. Another important consideration for the strikingly high elastic limit is that additives of other elements are present only to a very slight degree, but are preferably entirely eliminated. Method step b) consisting of solution treatment is advantageous but is not necessarily provided in accordance with the invention.

The cooling rate in method step e) should be at most 100° C. and is preferably lower but not higher.

The alloys manufactured in accordance with the method of the invention achieve elastic limits of 400 to 450 N/mm$^2$. The level of conductivity reaches values of up to a maximum of about 36% IACS.

A further improvement in the above-mentioned properties of the alloy is achieved by additional ageing of the alloy after the operation of cooling it. In a development of the invention the ageing operation is effected at 300° to 600° C. for a time of from 8 to 1 hour. The values for the elastic limit rise to 550 N/mm$^2$, while the level of conductivity reaches values of up to 50% IACS. Thermal conductivity also rises in proportion with electrical conductivity, from about 150 W/m°k to value of 200 W/m°k.

In accordance with a development of the invention the deep-drawability of the alloy is improved by a step whereby, after the cold rolling operation, an intermediate step of soft annealing at 400° C. to 750° C. for a period of 8 hours to 1 minute is effected.

Further developments of the invention provide heat deformation, after casting of the alloy, and a forging operation.

In accordance with a further embodiment of the invention a high elastic limit, a high level of conductivity and good cold deformability of the alloy are pronounced with a composition Cu (balance), Ni 1.8–4.7%, Si 0.4–0.9% and Fe 0–0.1%, but a particularly preferred composition is Cu (balance, Ni 2.3–4.5% and Si 0.4–0.9%.

BRIEF DESCRIPTION OF THE DRAWINGS

The invention will be described in greater detail hereinafter with reference to the drawings in which.

DETAILED DESCRIPTION

Figure 1:
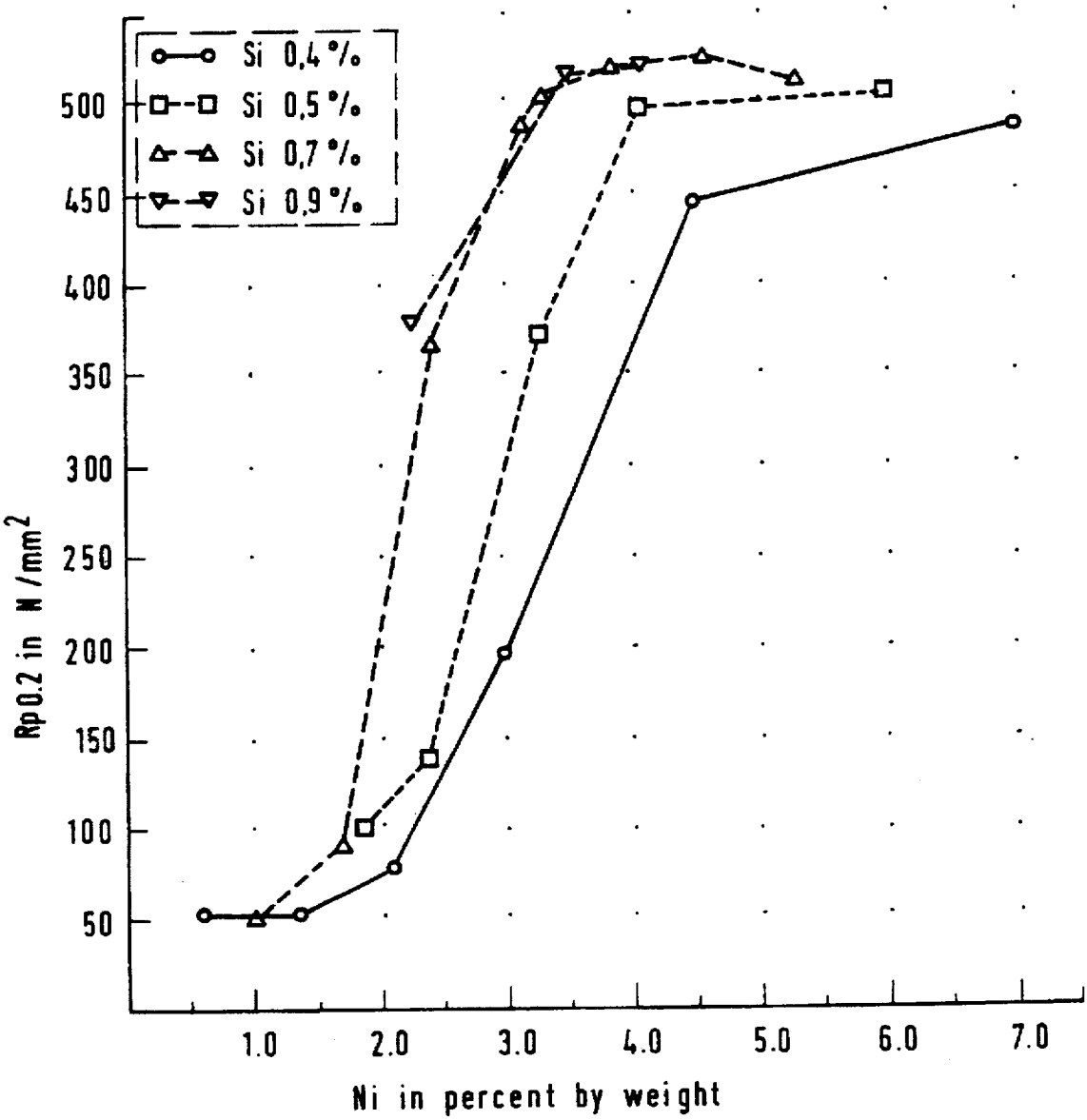
FIG. 1 shows the relationship between the elastic limit and the nickel content.

In investigating the alloys, it was surprisingly found that an intermediate annealing operation at a temperature of about 950° C. and given cooling to about 350° C. has the result of an unusual increase in the elastic limit. A high elastic limit which increasingly tends to occur upon cooling of the alloy from high temperatures is essential for those situations of use where the alloy serves to produce casings in which the wire lead-through means from the exterior into the interior of the casing are in the form of a pressure-englazing means (hybrid casing). Pressure-englazing and the specific problems thereof are described in greater detail for example in German patent application No. P 42 19 953.0. Because of the high elastic limit of the proposed alloy, even upon cooling of the metal after the pressure-englazing operation, there is still sufficient residual stress to produce a hermetic seal in the region of the pressure-englazing means. Very good electrical and thermal conductivity also goes along with that high elastic limit. Forging of the alloy is also possible, instead of deep drawing, in connection with a preceding hot-deformation step.

Tables 1 and 2 show the alloys investigated, with their compositions and the resulting properties.

TABLE 1

| Alloy No. | Alloys Cu | Ni | Si | Mg | Fe |
|---|---|---|---|---|---|
| 1873 | 98.26 | 1.01 | 0.64 | | |
| 1874 | 97.61 | 1.70 | 0.65 | | |
| 1875 | 96.92 | 2.42 | 0.65 | | |
| 1876 | 96.20 | 3.15 | 0.65 | | |
| 1877 | 95.48 | 3.85 | 0.66 | | |
| 1878 | 94.70 | 4.57 | 0.70 | | |
| 1879 | 93.98 | 5.30 | 0.66 | | |
| 1880 | 98.98 | 0.56 | 0.37 | | |
| 1881 | 98.15 | 1.36 | 0.38 | | |
| 1882 | 97.51 | 2.09 | 0.36 | | |
| 1883 | 96.82 | 2.50 | 0.67 | | |
| 1884 | 97.57 | 1.86 | 0.52 | | |
| 1885 | 98.76 | 0.96 | 0.27 | | |
| 1886 | 95.60 | 3.50 | 0.95 | | |

TABLE 1-continued

| Alloy No. | Alloys Cu | Ni | Si | Mg | Fe |
|---|---|---|---|---|---|
| 1887 | 94.28 | 4.60 | 1.16 | | |
| 1898 | 96.61 | 2.99 | 0.39 | | |
| 1899 | 95.10 | 4.50 | 0.41 | | |
| 1900 | 96.84 | 2.27 | 0.86 | | |
| 1901 | 94.96 | 4.08 | 0.89 | | |
| 1902 | 94.12 | 4.96 | 0.90 | | |
| 1903 | 93.24 | 5.83 | 0.86 | | |
| 1904 | 97.17 | 2.38 | 0.47 | | |
| 1905 | 96.26 | 3.28 | 0.47 | | |
| 1906 | 95.37 | 4.07 | 0.49 | | |
| 1908 | 96.72 | 2.75 | 0.56 | | |
| 1892 | 96.73 | 2.5 | 0.7 | 0.052 | |
| 1909 | 96.71 | 2.52 | 0.70 | 0.029 | |
| 1910 | 96.82 | 2.46 | 0.67 | | 0.056 |
| 1896 | 96.64 | 2.48 | 0.7 | | 0.11 |
| 1911 | 96.30 | 2.55 | 0.68 | | 0.46 |
| 1912 | 96.01 | 3.30 | 0.66 | | |

TABLE 2

Properties after annealing at 950° C.

| Alloy No. | Therm. Cond. (W/m °K.) | IACS (%) | $R_{p0.2}$ (N/mm$^2$) | VH 5 | Cold deformability before annealing | Comments |
|---|---|---|---|---|---|---|
| 1880 | 144 | 33.1 | 52 | 36 | good | |
| 1881 | 134 | 30.8 | 51 | 43 | " | |
| 1882 | 125 | 28.6 | 78 | 58 | " | Si const. 0.4% (ref) |
| 1898 | 118 | 27.1 | 196 | 96 | " | Ni rising |
| 1899 | 115 | 26.3 | 444 | 172 | " | |
| 1884 | 115 | 26.4 | 101 | 61 | good | |
| 1904 | 120 | 27.6 | 140 | 75 | " | |
| 1905 | 128 | 29.3 | 372 | 161 | " | Si const. 0.5% (ref) |
| 1906 | 128 | 29.4 | 495 | 190 | " | Ni rising |
| 1873 | 100 | 23.0 | 56 | 40 | good | |
| 1874 | 99 | 22.6 | 93 | 63 | " | |
| 1875 | 118 | 27.1 | 367 | 156 | " | Si const. 0.7% (ref) |
| 1876 | 138 | 31.6 | 487 | 193 | limited | Ni rising |
| 1912 | 142 | 32.5 | 502 | 197 | " | |
| 1877 | 147 | 33.8 | 518 | 199 | " | |
| 1878 | 150 | 34.4 | 523 | 203 | poor | |
| 1879 | 141 | 32.3 | 511 | 193 | " | |
| 1900 | 99 | 22.8 | 377 | 168 | good | |
| 1886 | 137 | 31.3 | 512 | 193 | poor | |
| 1901 | 157 | 35.9 | 517 | 195 | " | Si const. 0.9% (ref) |
| 1902 | 158 | 36.3 | 448 | 181 | " | Ni rising |
| 1903 | 147 | 33.6 | 434 | 187 | | |
| 1885 | 160 | 36.7 | 62 | 39 | good | |
| 1884 | 115 | 26.4 | 101 | 61 | " | |
| 1883 | 123 | 28.1 | 380 | 165 | " | Ni/Si ratio |
| 1886 | 137 | 31.3 | 512 | 193 | poor | const. 3.5 |
| 1887 | 150 | 34.3 | 444 | 190 | " | |
| 1904 | 120 | 27.6 | 140 | 75 | good | |
| 1908 | 129 | 29.5 | 383 | 160 | " | Ni/Si ratio |
| 1876 | 138 | 31.6 | 487 | 193 | limited | const. 4.5 |
| 1901 | 157 | 35.9 | 517 | 195 | poor | |
| 1892 | 119 | 27.2 | 398 | 187 | good | addition Mg |
| 1909 | 120 | 27.5 | 388 | 167 | " | addition Mg |
| 1910 | 118 | 27.1 | 406 | 170 | " | addition Fe |
| 1896 | 120 | 27.6 | 417 | 183 | " | addition Fe |
| 1911 | 119 | 27.2 | 348 | 147 | " | addition Fe |

The foregoing test results reveal the following rends in regard to conductivity, elastic limit and cold deformability:

with the silicon content kept constant conductivity (electrical and thermal) and elastic limit rise with a rising nickel content (with the exception of the alloy with 0.4% Si);

with the nickel content kept constant those values rise with a rising silicon content; and cold deformability improves with decreasing silicon content and/or with decreasing nickel content.

It was further found that a further increase in the elastic limit and conductivity can be achieved by ageing after the specific cooling operation.

The Tables also show that the range, which can preferably be used, of the composition of the alloy in regard to nickel is about 1.8 to 4.7% and that of silicon is at 0.4 to 0.9%, with the balance copper. An addition of iron of up to 0.1% results in a slight increase in the elastic limit, but with higher contents of iron the elastic limit falls again. The same applies to magnesium, a proportion of up to 0.7% permitting an increase in the elastic limit, whereas the elastic limit falls steeply with higher contents of magnesium. It is possible to envisage the additions of other elements such as P, Cr, Mn, Zr, Al and Ti, but they markedly reduce the elastic limit and are therefore already not advantageous for that reason.

Figure 2:
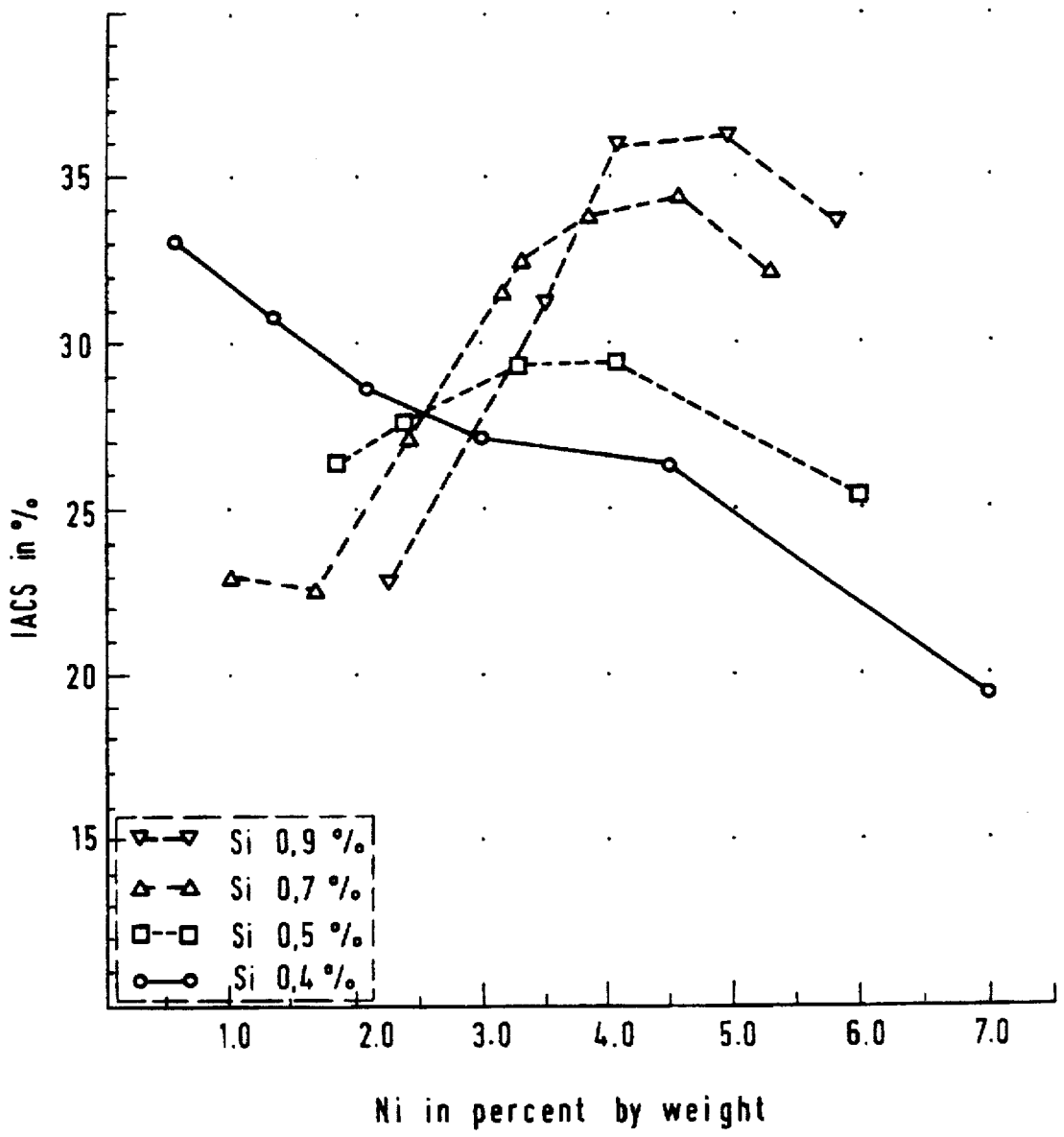
FIG. 2 shows the relationship between the conductivity and the nickel content.
Figure 3:
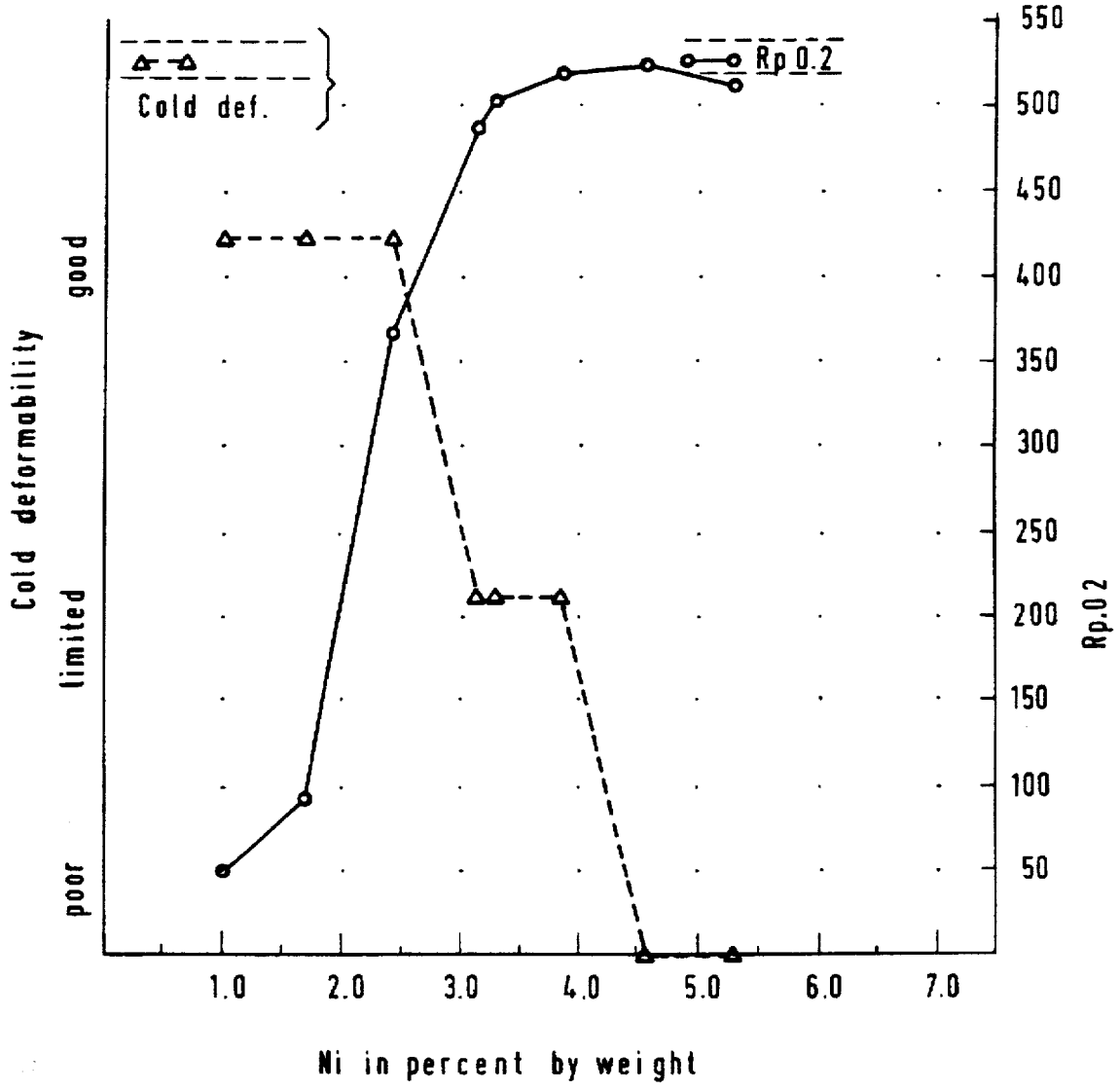
FIG. 3 shows the relationship between cold deformability, elastic limit and nickel content with a constant Si 0.7%.

An explanation for the increase in the elastic limit with a rising nickel content can be seen in the point that nickel silicides are increasingly precipitated at the grain boundaries. That gives rise to a grain boundary hardening action which produces the specified effect of increasing the elastic limit. With excessively high nickel contents the precipitations grow together on the grain boundaries, and the resulting brittleness of the alloy prevents good cold deformability. Reference is also directed to FIGS. 1 and 3. If the nickel contents or the silicon contents become too low, the elastic limit thus falls too greatly and the alloy can no longer be used for the intended situation of use. It can be seen from FIG. 1 that, with a constant silicon content, the elastic limit rises very steeply within a small range in respect of the variation in the nickel content. It is in the region of that steep rise, namely at the upper end thereof, that the particularly preferred composition of the alloy for the intended purpose is to be sought. It can be seen from FIG. 2 that, with the exception of alloys with a silicon content of 0.4% (or below), the conductivity in the preferred range of the nickel content also assumes very good values.

FIG. 3 plots the cold deformability and the change in the elastic limit, with a silicon content remaining constant at 0.7%, in dependence on varying nickel contents. It will be seen that cold deformability is approximately inversely proportional to the change in the elastic limit.

Figure 4:
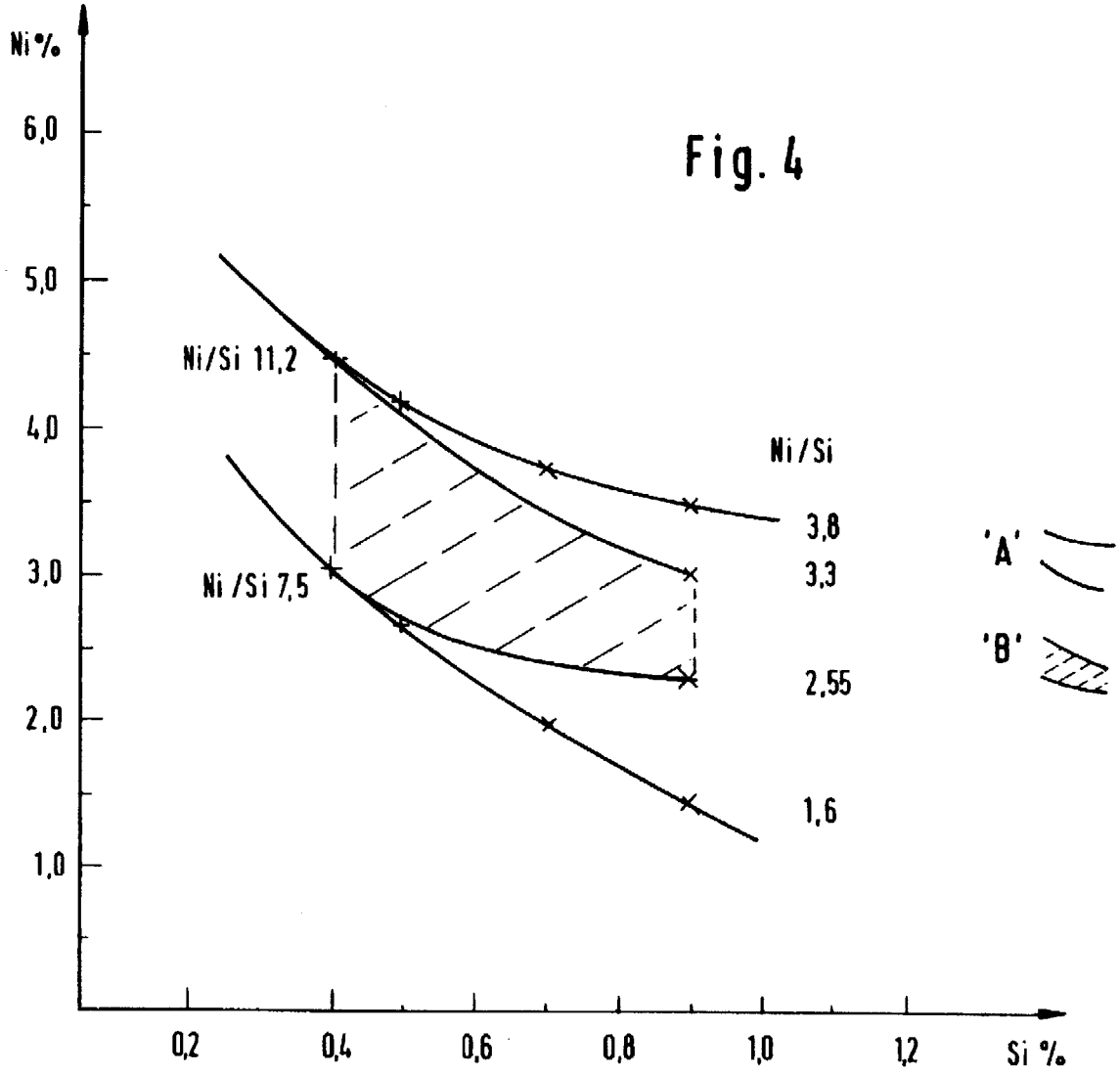
FIG. 4 shows the useful range of the alloy in dependence on the nickel and silicon contents.

In FIG. 4 the two outer curves enclose the area 'A' which can be used by the described alloys and which lies in a range in respect of silicon of between 0.2 and 1.0% and in respect of nickel in the range of between 1.5 and about 5.5%. The particularly preferred range 'B' in which a high elastic limit and high conductivity and good cold deformability simultaneously occur is between 0.4 and 0.9% Si and 2.3 and 4.5% Ni. It can also be seen from the Figure that the Ni/Si ratio can fluctuate in wide limits between 1.6 and 11.2, preferably between 2.5 and 11.2.

Figure 5:
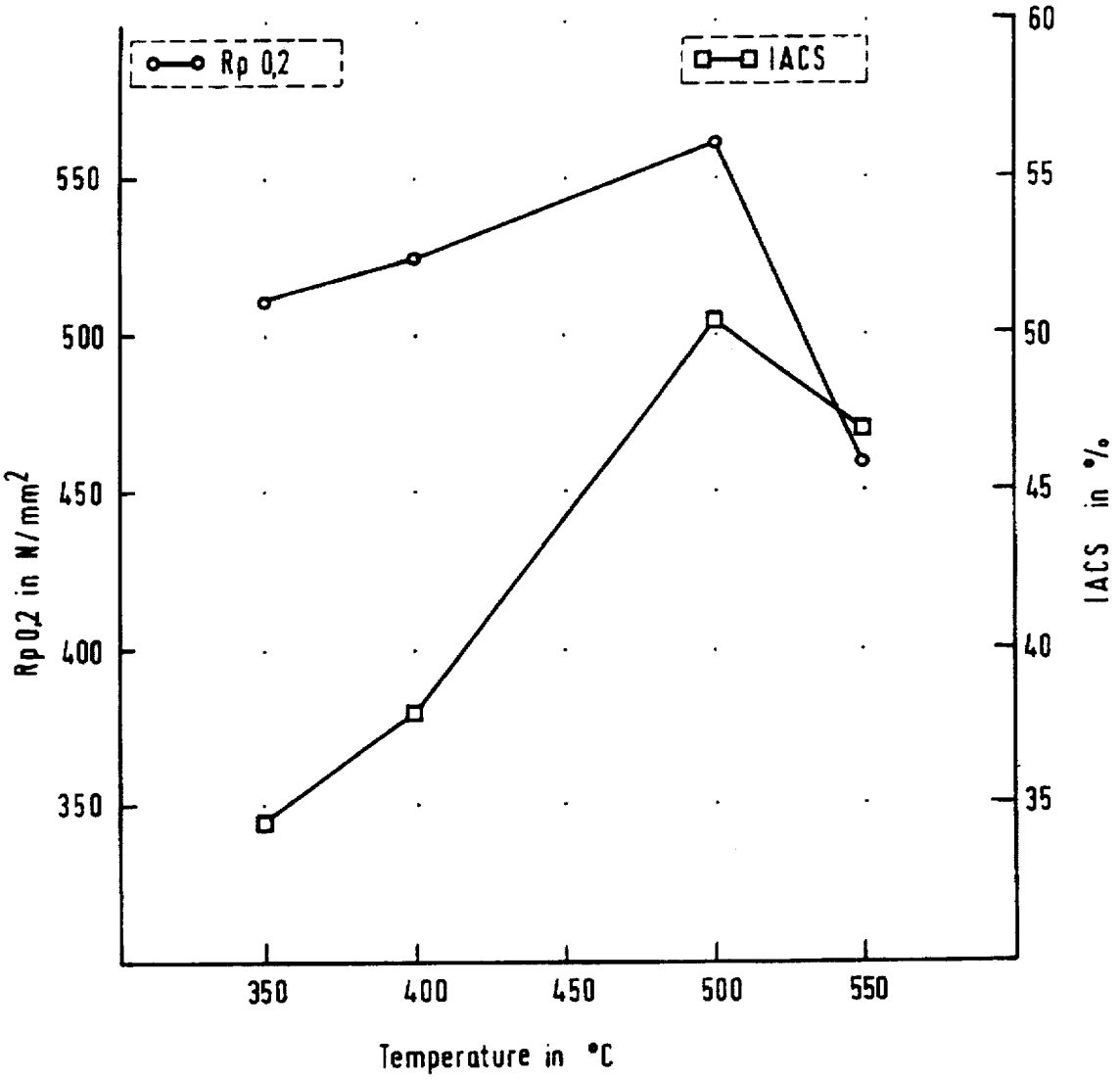
FIG. 5 shows the relationship between the elastic limit and conductivity and ageing temperature.

FIG. 5, illustrated in respect of the alloy number 1876, with a composition of Cu (balance), Ni 3.15% and Si 0.65%, shows the dependence of the elastic limit and conductivity on the ageing temperature, the last step in the manufacturing method. It will be seen from the Figure that, beginning with the ageing operation at a temperature of 350° C. the elastic limit rises from about 510 to about 570 N/mm$^2$ at a temperature of 500° C. and thereafter falls away steeply. In the case of conductivity, the rise in the same temperature range is substantially steeper to 50% IACS, and also falls away at higher temperatures.

Figure 6:
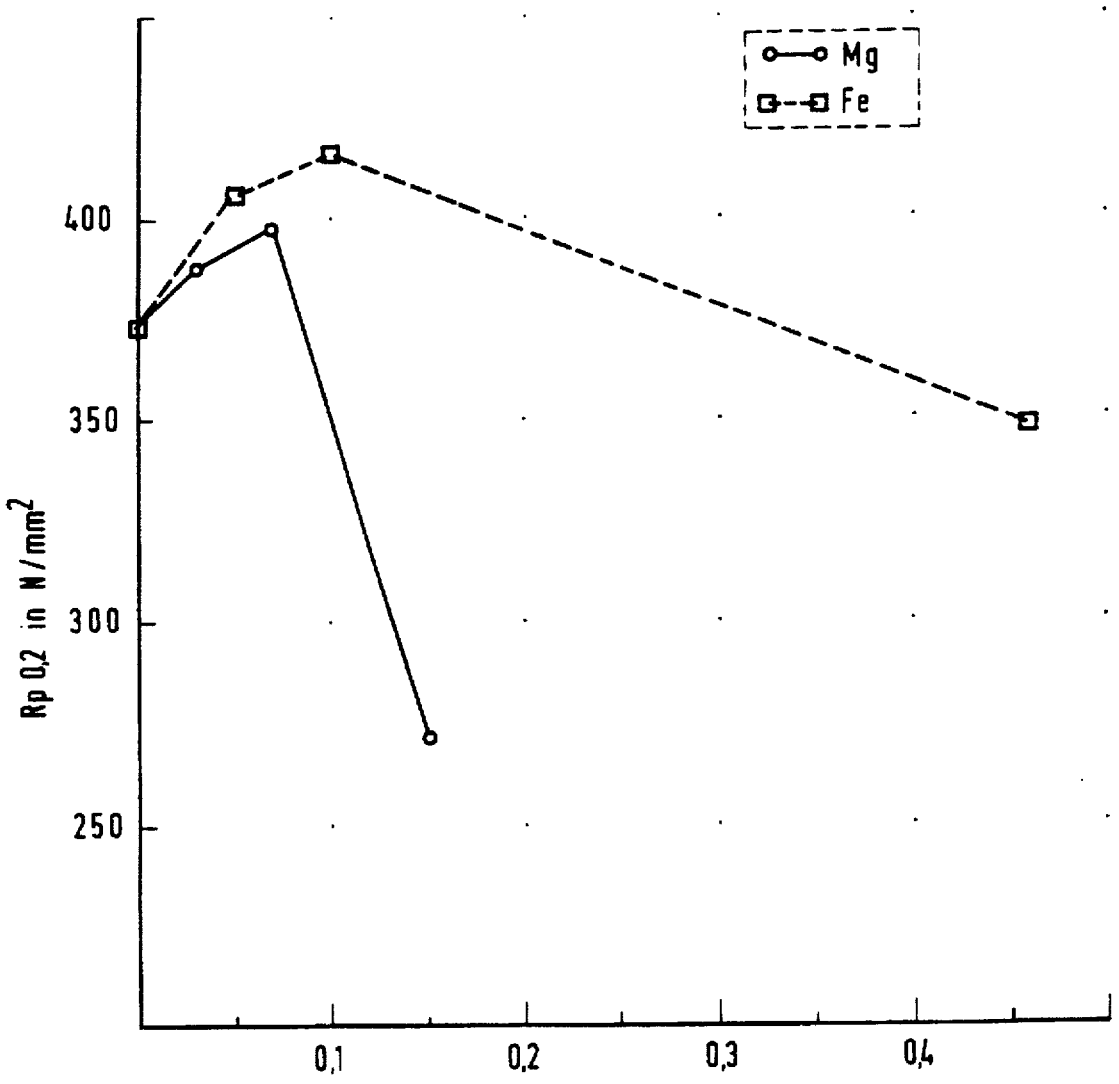
FIG. 6 shows the influence of additions on the elastic limit.

Finally FIG. 6 shows the influence of the additions of magnesium and iron to the proposed alloy. It will be seen that the additions are only very slight and are effective only up to small quantities added.

The proposed method of manufacturing the alloy in principle consists of the following steps:

a) casting the alloy b) solution treatment at 700°–900° C. for a period of 14–1 hour c) cold rolling with a reduction of at least 80% d) heating to 950° C.

e) cooling at at most 100° C./min to at least 350° C.

The addition of a method step f), namely ageing of the alloy at 300° to 600° C. for a period of 8 to 1 hours gives rise to the above-mentioned improvements in conductivity and increased elastic limit.

The insertion of a step g) between steps c) and d), namely soft annealing at 400°–750° C. for a period of 8 hours to 1 minute promotes subsequent deep drawing in accordance with step h). Upon the inclusion of a step i), hot deformation, after a) or b), forging of the alloy is also possible [method step hh) instead of h)].

A test production of the proposed alloy with a composition consisting of Cu (balance), Ni 2.9% and Si 0.67% was carried out as follows:

casting the alloy in a copper chill mould
solution treatment at 800° C. for a period of 4 hours
milling to 115×39×11 mm
cold rolling from 11 mm to 0.5 mm
annealing at 575° C. for a period of 4 hours
deep drawing
heating to 950° C.
cooling to about 300° C. in 25 minutes
cooling in air
ageing at 400° C. over 8 hours.

The method step of solution treatment was found to be advantageous in terms of the sample production operation, but not absolutely necessary. That method step is conventional in the manufacture of copper-nickel-silicon alloys, but it is possibly also unnecessary in accordance with the invention.

In step e), after fairly rapid cooling to 350° C., slow cooling to ambient temperature is advantageous. That can be effected by cooling in air or also in a cooling section.

We claim:

1. A method of manufacturing a copper-nickel-silicon alloy having a composition essentially consisting of Ni 1.5–5.5%, Si 0.2–1.0%, Fe 0–0.5%, Mg 0–0.1%, all by weight, with the balance Cu, comprising the steps of:

a) casting the alloy;

b) annealing the cast solution at 700°–900° C. for a period of from 14 hours down to 1 hour;

c) cold rolling with a reduction of at least 80%;

d) heating to 950° C.; and e) cooling at most at a rate of 100° C./min to at least 350° C.

2. A method according to claim 1, comprising the further step of:

f) aging the alloy at 300°–600° C. for a period of from 8 hours down to 1 hour.

3. A method of manufacturing a copper-nickel-silicon alloy having a composition essentially consisting of Ni 1.5–5.5%, Si 0.2–1.0%, Fe 0–0.5%, Mg 0–0.1%, all by weight with the balance Cu, comprising the steps of:

a) casting the alloy;

b) annealing the cast solution at 700°–900° C. for a period of from 14 hours down to 1 hour;

c) cold rolling with a reduction of at least 90%;

d) soft annealing at 400°–750° C. for a period of from 8 hours down to 1 minute;

e) deep drawing;

f) heating to 950° C.;

g) cooling at about 30–40° C./min to at least 350° C.; and h) aging at 300°–600° C. for a period of from 8 hours down to 1 hour.

4. A method according to one of claim 1 or 3, wherein a hot deformation step is implemented after step a).

5. A method according to claim 1 or 3, wherein a hot deformation step is implemented after step b).

6. A method according to claim 1 or 3, wherein a forging step replaces method steps d) and e).

7. A method according to claim 1 or 3, wherein said alloy has the composition of Ni 1.8–4.7%, Si 0.4–0.9%, Fe 0–0.1%, and the balance Cu.

8. A method according to claim 1 or 3, wherein said alloy has the composition Ni 2.3–4.5%, Si 0.4–0.9%, and the balance Cu.

9. A method according to claim 1 or 3, wherein said alloy has the composition Ni 2.9%, Si 0.75, and the balance Cu.

10. Pressure-englazable casings comprising an alloy produced by the method of claim 1 or 3.

11. Pressure-englazable, hermetically sealed casings for electronic components comprising an alloy produced by the method of claim 1 or 3.

* * * * *

UNITED STATES PATENT AND TRADEMARK OFFICE

CERTIFICATE OF CORRECTION

PATENT NO. : 5,675,883

DATED : October 14, 1997

INVENTOR(S) : Norbert Gaag, et al.

It is certified that error appears in the above-identified patent and that said Letters Patent is hereby corrected as shown below:

Column 2, line 32: after "balance" insert --)--

Column 5, line 1: "rends" should read --trends--

Column 5, line 64: "dependence" should read --dependency--

Column 8, line 1, Claim 6: "claim 1 or 3" should read --claim 3--

Column 8, line 11, Claim 9: "Si 0.75," should read --Si 0.7%--.

Signed and Sealed this

Fifth Day of January, 1999

*Attest:*

*Attesting Officer*

*Acting Commissioner of Patents and Trademarks*